US008088441B2

(12) United States Patent
Smith

(10) Patent No.: US 8,088,441 B2
(45) Date of Patent: Jan. 3, 2012

(54) DIRECT DIGITAL PRINTING METHODS FOR TEXTILES

(75) Inventor: John Smith, Greensboro, NC (US)

(73) Assignee: Precision Fabrics Group, Inc., Greensboro, NC (US)

( * ) Notice: Subject to any disclaimer, the term of this patent is extended or adjusted under 35 U.S.C. 154(b) by 1212 days.

(21) Appl. No.: 11/376,463

(22) Filed: Mar. 15, 2006

(65) Prior Publication Data

US 2006/0210719 A1 Sep. 21, 2006

Related U.S. Application Data

(60) Provisional application No. 60/663,063, filed on Mar. 18, 2005.

(51) Int. Cl.

| | |
|---|---|
| ***B05D 3/00*** | (2006.01) |
| ***B05D 5/00*** | (2006.01) |
| ***B05D 3/04*** | (2006.01) |
| ***B05D 7/04*** | (2006.01) |

(52) U.S. Cl. ..... 427/299; 427/428.01; 427/342; 427/256

(58) Field of Classification Search ..... 252/8.61; 546/112; 96/29; 427/428.01, 299, 342, 256
See application file for complete search history.

(56) References Cited

U.S. PATENT DOCUMENTS

| | | | | |
|---|---|---|---|---|
| 4,247,698 | A * | 1/1981 | Toyama et al. | 546/112 |
| 6,503,977 | B1 * | 1/2003 | Branham et al. | 524/555 |
| 6,776,921 | B2 * | 8/2004 | Nigam | 252/8.61 |
| 2003/0062506 | A1 * | 4/2003 | Nigam | 252/8.61 |
| 2006/0010619 | A1 * | 1/2006 | Hees et al. | 8/445 |

FOREIGN PATENT DOCUMENTS

| | | | |
|---|---|---|---|
| DE | 10244998 | A1 | 4/2004 |
| EP | 0995609 | A1 | 4/2000 |

* cited by examiner

*Primary Examiner* — Ling Choi
*Assistant Examiner* — Monique Peets
(74) *Attorney, Agent, or Firm* — Myers Bigel Sibley & Sajovec, PA

(57) ABSTRACT

A method of digitally printing textile substrates includes pretreating a textile substrate with a solution that is configured to limit penetration of aqueous colorant into fibers of the textile substrate, drying the pretreated textile substrate for a predetermined period of time, and digitally printing one or more aqueous colorants onto the dried textile substrate. The pretreatment solution comprises a polyamine with a quaternary ammonium compound attached to the polyamine backbone. The pretreatment solution may be applied onto one or both sides of a textile substrate.

5 Claims, 3 Drawing Sheets

DIRECT DIGITAL PRINTING METHODS FOR TEXTILES

CROSS-REFERENCE TO RELATED APPLICATIONS

This application claims the benefit of, and incorporates herein by reference in its entirety, the following U.S. Provisional Application: U.S. Provisional Application No. 60/663,063, filed Mar. 18, 2005.

FIELD OF THE INVENTION

The present invention relates generally to fabrics and, more particularly, to digital printing of fabrics.

BACKGROUND OF THE INVENTION

Digital printing of textile substrates involves applying small quantities of colorant (e.g., inks, dyes, pigments, etc.), known as pixels, in predetermined areas of a textile substrate, for example via ink jet printing. Typically, only one colorant is used for a particular pixel, and variations in colors and shades are accomplished by positioning different colored pixels in adjacent or near-by areas. Although the actual color of an individual pixel is not changed, the impression to a viewer is that the area containing different colored pixels is a color or shade that is different than any of the individual pixels in the associated area. The impression is created because the pixels are so small that a viewer cannot readily perceive the individual pixels. Rather, the viewer perceives an average of the pixel colors.

Conventional digital printing of polyester and polyester-rich fabrics is typically an indirect printing process. Disperse dyes are first printed on coated transfer print paper and then the print is sublistatically transferred to a textile substrate using a heated press or similar machine. Printing technology has evolved to allow fabrics to be printed directly, and inks and dyes are available for directly printing virtually any type of woven or non-woven fabric, including cotton, polyester-cotton, silk, and nylon. Inks containing acid dyes also are available for printing polyamides such as nylon, silk and wool. Inks composed of dispersions of disperse dyes are available for direct printing of 100% polyester fabrics and polyester-rich fabrics.

Direct digital printing has several advantages over transfer (sublistatic) printing. For example, there are a wider selection of inks and dyes available that have improved wash and light fastness characteristics and increased size of the color gamut. Digital printing inks and dyes typically have less negative effects on textile properties such as hand, for example. In addition, because of the wider selection of inks and dyes, color matching is enhanced. Digital printing may also help streamline fabric production processes.

However, direct digital printing on textiles that vary in fiber content, weight, thickness, ink absorbency, and yarn size, that must be washable, light fast, crock resistant and wearable and require multiple ink sets can present a broad array of challenges. For example, a colorant may bleed outside of the intended pixel area, or may be absorbed into the fibers of a textile substrate. If a colorant does not completely fill one or more intended pixel areas, an image on a textile substrate can lose color intensity due to the underlying textile substrate color. If a colorant is absorbed into the textile fibers, color intensity can also be lost. If a colorant bleeds outside of the intended pixel area, image sharpness and intensity can be negatively affected.

In direct digital printing, evenness of print in fully covered (blotch) areas can be difficult to obtain as can be fine line definition. In traditional fabric printing techniques, e.g., rotary screen printing, ink chemistry controls print quality. For example, an ink may contain materials such as alginates or synthetic thickeners which, when combined with dyes and other additives, and in combination with screen selection, will provide both even blotches (larger areas covered with print) and fine line definition. Additionally, in rotary screen printing it is possible to tailor each color, (i.e., screen) to meet specific performance needs. For example, if a blotch color is being printed on one or several screens, it may have a different paste formulation than a screen being used to print a fine line. This is not possible with digital printing since both fine lines and blotches are printed with the same inks. Additionally, if a digital print head is not functioning perfectly, there may be striations in the blotch areas.

To address some of the problems associated with direct digital printing, traditional print thickeners such as sodium alginates, have been added to digital printing colorants. Unfortunately, the use of traditional print thickeners in direct digital printing processes can be problematic. Alginates absorb moisture and must be removed before shipping due to textile substrate stiffness and odor. Also, these thickeners must be applied to a textile substrate via a coating, printing or pad-dip application. If viscosity becomes high, application via pad-dip can be difficult to control. Application via a coating mechanism, either direct such as knife over roll or knife over gap or foam coating, gives better control but may be more expensive than pad-dip methods.

Textile fabrics have been treated with fluorochemicals to lower the textile substrate surface tension. This results in aqueous-based inks sitting on the textile substrate surface and then being allowed to fix to the fibers. Unfortunately, drying can be very slow and ink droplets can, if the amount of fluorochemical is too high or uneven, literally run off the textile substrate.

In digital printing, color yield (i.e., the amount of ink required to color a particular portion of a fabric) is an important issue because ink costs may be more than one hundred times that of traditional dyes. In fact, ink costs may well represent over 30% of the cost of a digitally printed fabric.

Traditionally, a printed fabric, following printing, is fixed in a steamer or by a thermofixation method, washed and then dried. Washing is required to remove any unfixed dye and to remove print paste residuals. If left on a printed fabric, unfixed dye and print paste residuals can cause problems with crocking, wash fastness and staining, hand, and flammability. If a printed fabric is intended to meet flame resistance criteria, print paste residuals may actually increase the fabric's propensity to burn.

Accordingly, there exists a need for improved methods of digitally printing textile substrates.

SUMMARY OF THE INVENTION

In view of the above discussion, a method of digitally printing textile substrates, according to embodiments of the present invention, includes pretreating a textile substrate with a solution that is configured to limit penetration of aqueous colorant into fibers of the textile substrate, drying the pretreated textile substrate for a predetermined period of time, and digitally printing one or more aqueous colorants onto the dried textile substrate. The pretreatment solution comprises a polyamine with a quaternary ammonium compound attached to the polyamine backbone. The pH of the pretreatment solution is adjusted to between about 4 and 7 using citric acid and/or sodium hydroxide or similar chemicals as appropriate. The pretreatment solution may be applied onto one or both sides of a textile substrate via various methods including, but not limited to, coating and padding.

According to embodiments of the present invention, the digitally printed textile substrate may be thermofixed in an oven for a predetermined period of time or fixed using traditional steaming methods. Although not necessary, unfixed colorant and/or residuals may be removed from the textile substrate after thermofixing, for example, using a basic solution such as sodium hydroxide and sodium hydrosulfite.

Embodiments of the present invention are advantageous because the penetration into fabrics by aqueous colorants can be controlled without interfering with fabric properties. Pretreatment solutions, according to embodiments of the present invention, can be applied using conventional equipment and can greatly enhance color yield. Moreover, the flammability of flame retardant fabric is not adversely affected by unfixed and unremoved colorant and pretreatment solution.

DETAILED DESCRIPTION OF THE INVENTION

The present invention now is described more fully hereinafter with reference to the accompanying drawing, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. All publications, patent applications, patents, and other references mentioned herein are incorporated herein by reference in their entireties. As used herein, the term "and/or" includes any and all combinations of one or more of the associated listed items.

Figure 1:
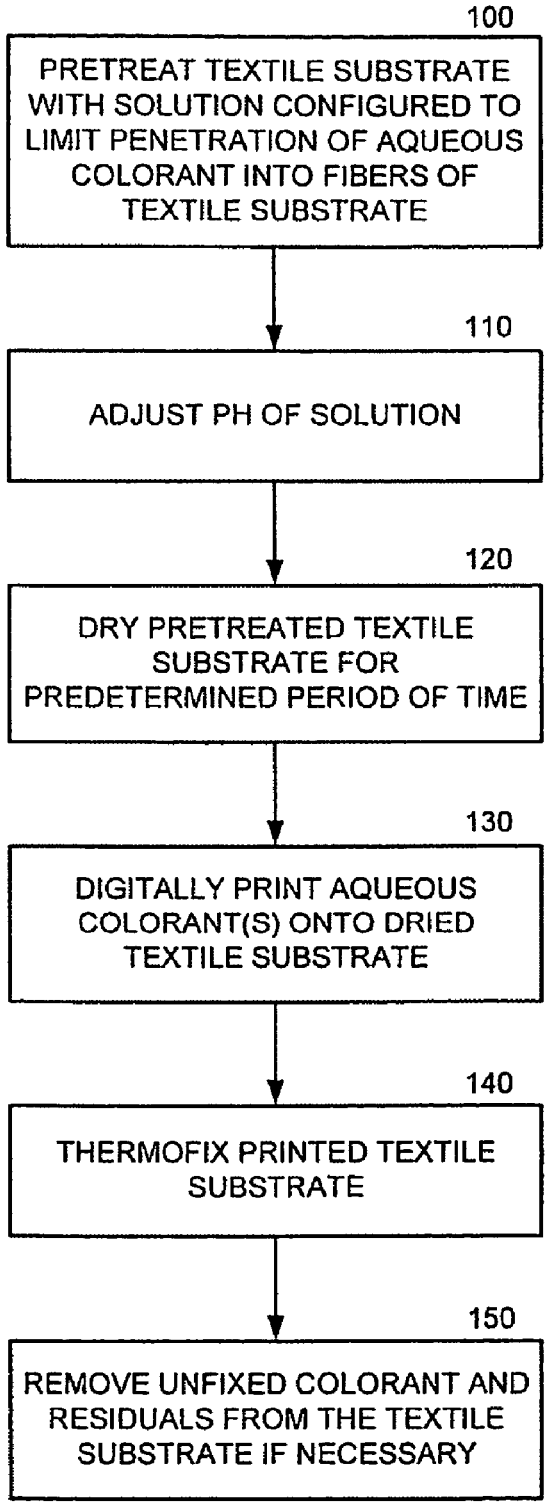
FIG. 1 is a flow chart that illustrates methods of digitally printing textile substrates, according to embodiments of the present invention.

Referring now to FIG. 1, methods of digitally printing textile substrates, according to embodiments of the present invention, are illustrated. Virtually any type of textile substrate may be pretreated in accordance with embodiments of the present invention including, but not limited to, woven textiles, nonwoven textiles, etc., formed from various fibers including flame retardant polyester.

Initially, a textile substrate is pretreated with a solution that is configured to limit penetration of an aqueous colorant into fibers of the textile substrate (Block 100). The term "colorant" as used herein refers to any type of material printed on a textile substrate via a digital printer including, but not limited to, inks, dyes, pigments, etc.

Exemplary pretreatment solutions are an aqueous solution of a polyamine with a quaternary ammonium compound attached to the polyamine backbone. The preferred compound is available from the Zschwimmer & Schwarz as Zetesal CPT. The pretreatment solution can be applied using any of various known techniques. For example, the pretreatment solution can be applied to one or both sides of the textile substrate via padding techniques. The pretreatment solution can be applied to one or both sides of the textile substrate via coating techniques (e.g., knife over pad, scrape, knife over roll, foam coating, etc.). Moreover, the technique for applying the pretreatment solution can be based on the chemical(s) in the pretreatment solution.

Preferably, the pH of the solution is adjusted, for example to between about 4 and 7 (Block 110). Exemplary substances for adjusting pH include, but are not limited to, citric acid and sodium hydroxide. Various other materials may also be utilized to adjust pH of the pretreatment solution, as would be understood by those skilled in the art.

The pretreated textile substrate is then dried for a predetermined period of time (Block 120). Drying times may vary depending on the type of textile substrate and/or pretreatment solution applied thereto. For example, drying may be for 0.5 to 5 minutes at 200° C. to 300° C. One or more aqueous colorants are then digitally printed onto the dried textile substrate via a digital printer, e.g., an inkjet printer (Block 130). The pretreatment of the textile substrate limits penetration of the aqueous colorant into the fibers of the textile substrate. Without wishing to be held to any particular theory, Applicant believes that the pretreatment solution limits penetration of aqueous colorant into the fibers of a textile substrate in either or both of the following ways. The pretreatment solution may bind molecules of the aqueous colorant to the surface of the fibers and/or may increase the surface tension of the fibers. Wet pickup is typically 40 to 50 percent.

After printing, the printed textile substrate may be thermofixed (Block 140). Thermofixing can be performed, for example, by placing the printed textile substrate in an oven at 204° C. for 90 seconds. Once fixed, the colorant and the pretreatment solution do not adversely affect the flame resistance properties of the substrate. This is contrasted to conventional colorant fixatives which, if not removed, can adversely affect the flammability characteristics of a substrate, particularly if made from flame retardant fibers such as flame retardant polyester.

According to embodiments of the present invention, unfixed colorant and residuals from the textile substrate may be removed, if necessary (Block 150). Exemplary solutions for removing unfixed colorant and residuals include, but are not limited to, sodium hydroxide and sodium hydrosulfite, the selection of which is within the skill of one in the art.

According to embodiments of the present invention, color yield is enhanced by controlling the degree which an aqueous colorant penetrates into the fibers of a textile substrate and the yarn bundle. By either absorbing the water present in the aqueous colorant, binding the dye molecule to the fiber surface and/or controlling the surface tension of the textile substrate, color yield can be improved according to embodiments of the present invention.

EXAMPLES

100% polyester fabric (2 ply 150 denier inherently flame retardant polyester in the warp and 2 ply 150 denier regular polyester in the filling) was padded with a chemical solution containing various chemicals as described in the examples below. The fabric was then dried and printed on a digital printer using disperse dyes. The fabrics were then thermofixed to develop and fix the color after which the properties of the color and fabric were tested. Additionally, the printed samples were allowed to age one and two weeks before fixing to determine if there was an effect from ageing.

Comparative Examples 1 and 2

100% polyester fabric in a plain weave weighing (Comparative Example 1) about 156 g/sq. m was padded through a chemical solution containing 20 g/L sodium alginate (Comparative Example 2), Dialgin MV-50 (Noveon) and the pH checked. The pH was adjusted to between 4 and 7 using citric acid or sodium hydroxide as indicated. Before padding, the solids were measured by weighing and then drying the solutions. The fabric was padded in a two roll pad, wet pick up recorded, and the dried in a hot air oven at 100 C for 1 minute. In this case the wet pick up was about 73% on weight of fabric (owf). The solids add on was 1.46%

After drying the fabric was printed using a test print containing both fine lines and blotches. All samples were printed one after the other on the same printer using the same disperse ink system. The printer was a Mimaki JV-4. The fabric was then thermofixed in a hot air oven at 204° C. for 90 seconds.

After fixation the fabric was tested for hand (stiffness), colorfastness to light, wet and dry crock, colorfastness to laundering, discoloring of the fabric and print sharpness and evenness. An afterclear composed of 1 g/L sodium hydroxide and 2 g/L sodium hydrosulfite was used to remove unfixed dye or objectionable residuals of the pretreatment.

Examples 1-4

The same process as described in Comparative Examples 1 and 2 was carried out using 10, 20, 30 and 40 g/L of a quaternary ammonium compound (Zetasal CPT) from Zshimmer & Schwartz. The solids add on was 0.79%. No afterclear was required. The results are as follows:

| | Test Method: | | | | | | | | | | | | | |
|---|---|---|---|---|---|---|---|---|---|---|---|---|---|---|
| Sample | Color Yield (%) | NFPA 701-89 Warp Char Length (in) | NFPA 701-89 Fill Char Length (in) | NFPA 701-89 Drip W (sec) | NFPA 701-89 Drip F (sec) | AATCC 8-2001 Crock (Wet) | Crock (Dry) | AATCC 61-2003 IIA Wash (Polyester) | IIA Wash (Nylon) | IIA Wash (Acetate) | INDA 90.3 Handleometer | AATCC 16-2003 Lightfastness 20 hrs | Lightfastness 40 hrs | Lightfastness 60 hrs |
| Comparative Ex. 1 | 100 | 5.5 | 6.16 | 0 | 0 | 4.5 | 4.5 | 5 | 3 | 3 | 10.7 | 4.5 | 4.5 | 4.5 |
| Comparative Ex. 2 | | 11" | 9.75 | 21 | 22.5 | 4.5 | 5 | 5 | 2.5 | 3 | 12 | 4.5 | 4.5 | 4.5 |
| Examples 1 | 160 | 6.08" | 5.17" | 0 | 2.3 | 4.5 | 4.5 | 5 | 2.5 | 3 | 12 | 5 | 5 | 4.5 |
| Examples 2 | 160 | 4.17" | 5.83" | 0 | 16 | 4.5 | 4.5 | 5 | 2.5 | 3 | 12.7 | 5 | 5 | 4.5 |
| Examples 3 | 180 | 4.42" | 4.33" | 0 | 0 | 4.5 | 4 | 5 | 2.5 | 3 | 10.9 | 5 | 5 | 4.5 |
| Examples 4 | 197 | 5" | 3.42" | 4 | 0 | 4.5 | 4.5 | 5 | 2.5 | 3.5 | 11.9 | 5 | 5 | 4.5 |

Figure 2:
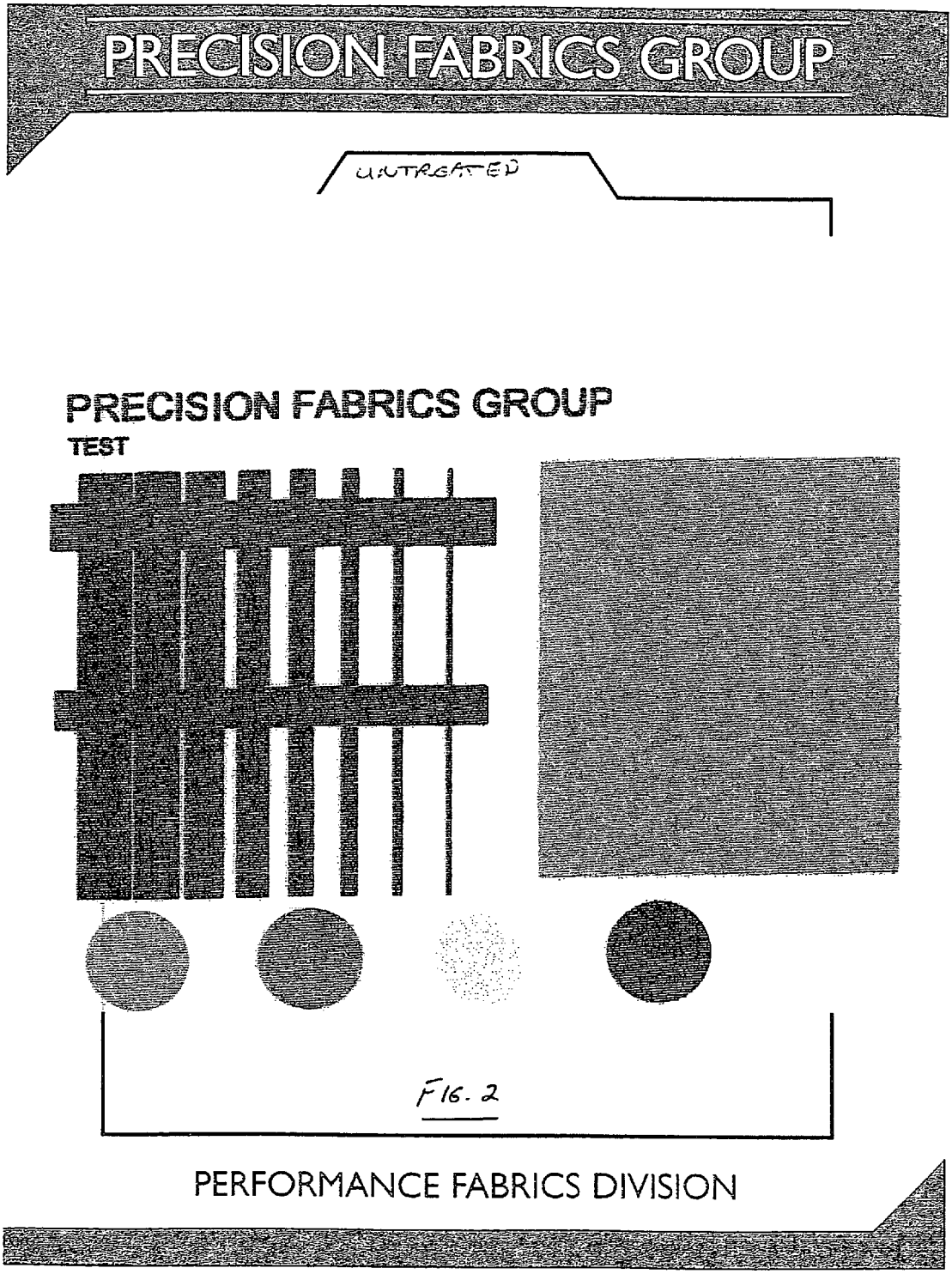
FIG. 2 illustrates an untreated textile substrate digitally printed with multiple colorants.

Referring now to FIG. 2, an untreated textile substrate (Comparative Example 1) that has been digitally printed with multiple aqueous colorants is illustrated. FIG. 2 is the control fabric to compare all the response variables. In this case, the major visible differences are color yield and print sharpness. Examples 1-4 show up to 200% color yield over the control without effecting other properties adversely.

Figure 3:
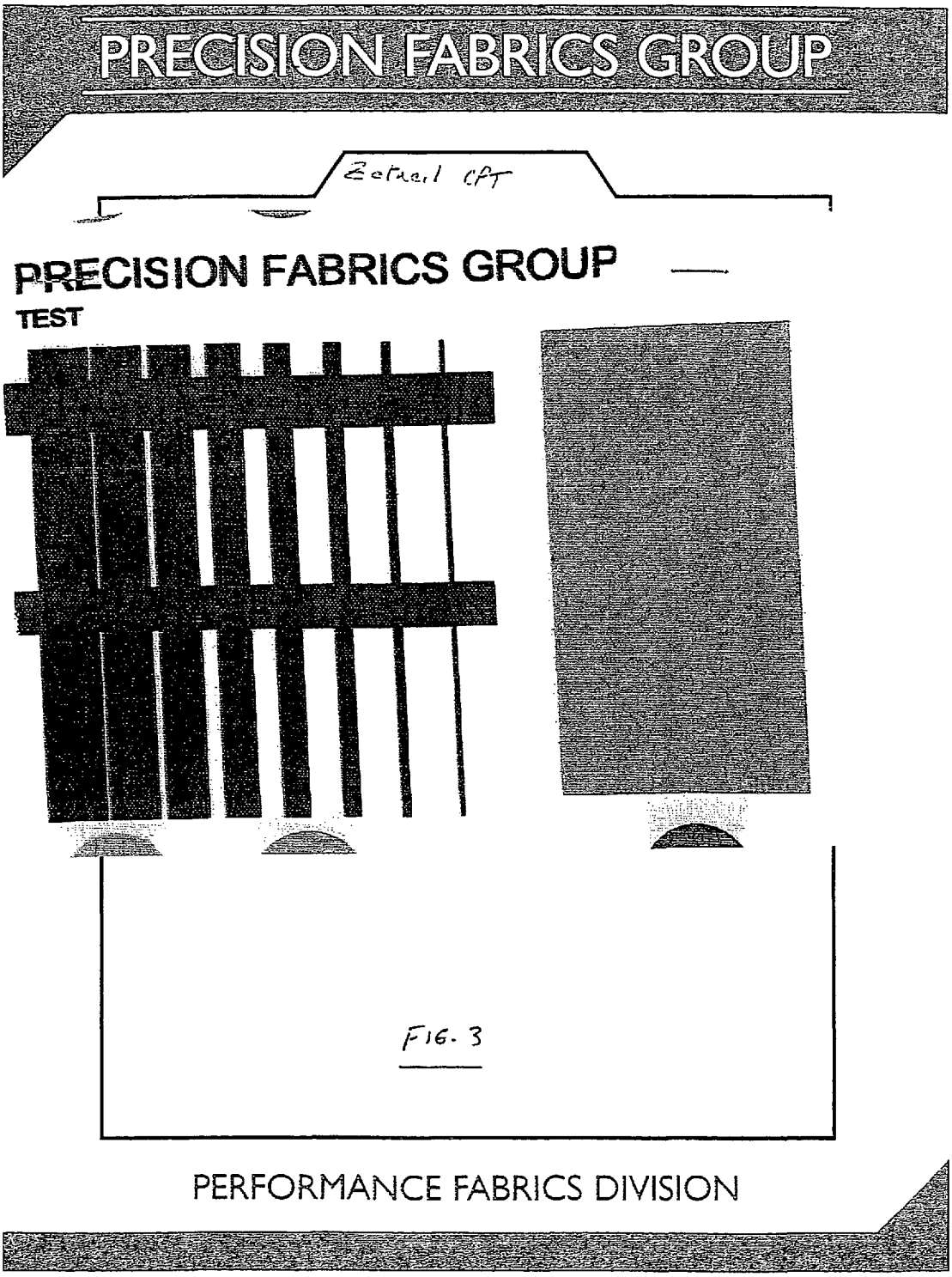
FIG. 3 illustrates a textile substrate digitally printed with multiple colorants, wherein the textile substrate was pretreated with a solution configured to limit penetration of aqueous colorant into the fibers of the textile substrate, according to embodiments of the present invention.

FIG. 3 illustrates a textile substrate digitally printed with multiple colorants, wherein the textile substrate was pretreated with a solution configured to limit penetration of aqueous colorant into the fibers of the textile substrate, according to embodiments of the present invention. As can be seen, the digital image is crisper as compared with the untreated textile substrate of FIG. 2. This illustrates improved color yield of the invention, improved definition of fine lines and edges, and more even (less striated) blotches from the untreated textile substrate.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A method of digitally printing textile substrates, comprising:

pretreating a textile substrate with a solution that is configured to limit penetration of disperse dye into fibers of the textile substrate and the solution comprises a polyamine with a quaternary ammonium compound attached to the polyamine backbone;

drying the pretreated textile substrate;

digitally printing one or more disperse dyes onto the dried textile substrate;

thermofixing the substrate in an oven; and removing unfixed disperse dye.

2. The method of claim 1, wherein the pretreating step comprises adjusting the pH of the solution to between about 4 and 7.

3. The method of claim 2, wherein pH is adjusted using citric acid and/or sodium hydroxide.

4. The method of claim 1, wherein the pretreating step comprises applying the solution onto one or both sides of the textile substrate via padding.

5. The method of claim 1, wherein the pretreating step comprises coating one or both sides of the textile substrate with the solution.

* * * * *